United States Patent [19]

Phillips

[11] 4,068,335

[45] Jan. 17, 1978

[54] MATTRESS HAVING AN UPPER INTERNAL MATERIAL-CONTAINING CHAMBER

[76] Inventor: Raymond M. Phillips, 2566 Tuna Canyon Road, Malibu, Calif. 90265

[21] Appl. No.: 724,355

[22] Filed: Sept. 17, 1976

[51] Int. Cl.[2] ..... A47C 27/08; B31F 7/00

[52] U.S. Cl. ..... 5/371; 5/365

[58] Field of Search ..... 5/349, 350, 365, 370, 5/371; 128/376

[56] References Cited

U.S. PATENT DOCUMENTS

| | | | |
|---|---|---|---|
| 3,585,356 | 6/1971 | Hall | 5/60 |
| 3,735,432 | 5/1973 | Kreten | 5/370 |
| 3,778,852 | 12/1973 | Penn et al. | 5/371 |
| 3,918,110 | 11/1975 | Cantillo et al. | 5/371 |
| 3,925,835 | 12/1975 | Pennington et al. | 5/371 |
| 3,986,213 | 10/1976 | Lynch | 5/370 |
| 4,006,501 | 2/1977 | Phillips | 5/371 |

*Primary Examiner*—Casmir A. Nunberg
*Attorney, Agent, or Firm*—Robert J. Schaap

[57] ABSTRACT

A water bed mattress for supporting an individual in an inclined position which is comprised of an upper sheet and a lower sheet and both of which are formed of a foldable, flexible plastic material. A continuous outer side wall extends between and is secured in operative relationship to the upper and lower sheets. A continuous panel is operatively secured to the upper sheet inwardly of the peripheral end margin of the upper sheet by means of a first continuous seal. This latter panel is also secured to the upper sheet at a point in close proximity to the peripheral margin thereof by a second continuous peripheral seal in order to form a material-containing chamber which is bounded by a portion of the upper sheet between the first and second seals. A liquid chamber is bounded by the lower sheet, the side wall and the remaining portion of the upper sheet and said panel. This material-containing chamber continuously extends around the periphery of the upper sheet so that the peripheral portion of the upper sheet is supported by material in the material-containing chamber. In a preferred aspect of the invention, the material-containing chamber is filled with air and the liquid chamber is filled with water. The peripheral side wall is actually formed by flaps which are downwardly struck from the upper sheet and upwardly struck from the lower sheet and which are sealed together in order to form this peripheral side wall. The present invention also provides the unique form of manufacturing the water bed mattress of the present invention.

26 Claims, 15 Drawing Figures

MATTRESS HAVING AN UPPER INTERNAL MATERIAL-CONTAINING CHAMBER

BACKGROUND OF THE INVENTION

This invention relates in general to certain new and useful improvements in mattresses having fluid-containing internal chambers and the method of making the same and, more particularly, to mattresses of the type stated which include a central liquid chamber which is surrounded by an upper material-containing chamber but which permits the liquid chamber to be substantially continuous with the lower surface of the mattress and with the material-containing chamber extending around the periphery of the liquid chamber.

In recent years, water beds have become widely commercially acceptable and have found substantially increased use. It has now been fairly well recognized that water beds, that is those forms of beds which employ a water filled mattress, have not only enjoyment value, but therapeutic value as well. In general, it has been found that many people find that it is not only more enjoyable, but is more restful to sleep on a water bed mattress than other forms of conventional mattresses filled with solid, but nevertheless, resilient, material.

The present commercially available water bed mattresses generally comprise a rectangular shell formed primarily of some form of a fairly flexible plastic material and which is filled with water. This form of water bed mattress is thereupon supported in, and by virtue of its construction is required to be supported in, a rigid frame.

In recent years, there have been various other forms of water bed mattresses which include an air frame peripherally surrounding a water bladder, as for example in the Penn et al. U.S. Pat. No. 3,778,852, and the Pennington et al. U.S. Pat. No. 3,787,907. This latter form of water bed mattress, which includes a surrounding air frame, is typically referred to as an air frame water bed mattress. These air frame mattresses differ substantially from the purewater bed mattress, without the air frame, in that those mattresses including the air frame do not require the employment of a rigid structural frame.

The presently available water bed mattresses which do not include the air frame suffer from a large number of deficiencies such as the fact that these mattresses do not obviate the problem of wave action created in the water in the water chamber due to a sudden localized force. Consequently, when a person lies upon a water bed mattress without the surrounding air frame, the water shifts substantially, thereby creating substantial wave action and also the attendant displacement of the surface contour of the mattress.

The other forms of water bed mattresses including the air frame surrounding the water bladder, as exemplified by the Penn et al. Patent and the Pennington et al. Patent mentioned above, also suffer from a number of substantial disadvantages. It has again been well established that those water beds which include the surrounding air frame and which avoid the necessity of a rigid frame do not provide the required degree of comfort. It has been theorized that these water bed mattresses eliminate some of the wave action which is created by a sudden localized force. Nevertheless, it is also well established that the air bladder is relatively incompressible with respect to the water bladder. Consequently, the water bed mattresses which include the surrounding air frame do not provide constant and adequate support. The same generally holds true of those water bed mattresses which do not employ the air frame surrounding the water bladder. One of the primary problems of each of these conventional water beds is that they do not provide equal water flotation with respect to the entire upper surface of the water bed mattress.

Another important disadvantage with respect to the water bed mattresses of each of the aforementioned types is that they are not constantly sized with respect to a supporting structure or, otherwise, a supporting frame. Consequently, difficulty often arises in fitting the water bed mattress, when filled with water, or otherwise with water in the water bladder and air in the air bladder, to the supporting frame or a supporting structure. Even more importantly, these water bed mattresses which are presently commercially available do not provide any adequate safety feature in the event of punctures in the mattress itself which could result in immediate and substantial discharge of water with resultant damage.

The present invention obviates these and other problems in the provision of a fluid-containing mattress which includes a pair of upper and lower sheets having peripherally extending, perpendicularly struck side wall flaps. These side wall flaps are secured to each other in order to form an outer peripheral end wall, thereby defining a rectangularly shaped water bed mattress. A panel extends across portions of the upper sheet and is sealed to the upper sheet by one heat seal in close proximity to the end wall and is also sealed to the upper sheet by another heat seal spaced inwardly from the first heat seal in order to thereby provide a material-containing chamber along the upper periphery of the mattress. In a more preferred aspect of the invention, the panel is a continuous panel extending peripherally around the upper sheet of the mattress and is heat sealed to the upper sheet somewhat inwardly of its peripheral margin to form the second of the heat seals. Moreover, the other end of the panel which is heat sealed to the upper sheet is preferably heat sealed to this sheet at a point in close proximity to the end wall.

In accordance with this construction, the upper material-containing chamber constitutes and upper flotation chamber which provides peripheral edge support on the mattress. In addition, this upper material-containing pocket prevents a so-called "bottoming-out" when one sits on the edge of the mattress. This form of mattress also equalizes for differential weight and body mass.

OBJECTS OF THE INVENTION

It is, therefore, the primary object of the present invention to provide a mattress for supporting an individual in an inclined position, and which includes an upper material-containing chamber surrounding the upper periphery of the mattress.

It is another object of the present invention to provide a mattress of the type stated which is relatively light in weight when filled with water or comparable fluid in the liquid chamber, as compared to other forms of commercially available water bed mattresses.

It is a further object of the present invention to provide a mattress of the type stated which provides constant body support on the upper surface thereof.

It is an additional object of the present invention to provide a mattress of the type stated which is capable of reducing wave action in the fluid chamber of the mattress created by the impingement of localized forces.

It is also an object of the present invention to provide a mattress of the type stated which is durable in its construction and provides a safety feature substantially greater than any conventional available form of water bed mattress.

It is another salient object of the present invention to provide a method of making the mattress of the type stated which is highly efficient in its operation and requires a minimal amount of manual labor.

With the above and other objects in view, my invention resides in the novel features of form, construction, arrangement and combination of parts presently described and pointed out in the claims.

BRIEF DESCRIPTION OF THE DRAWINGS

Figure 1:
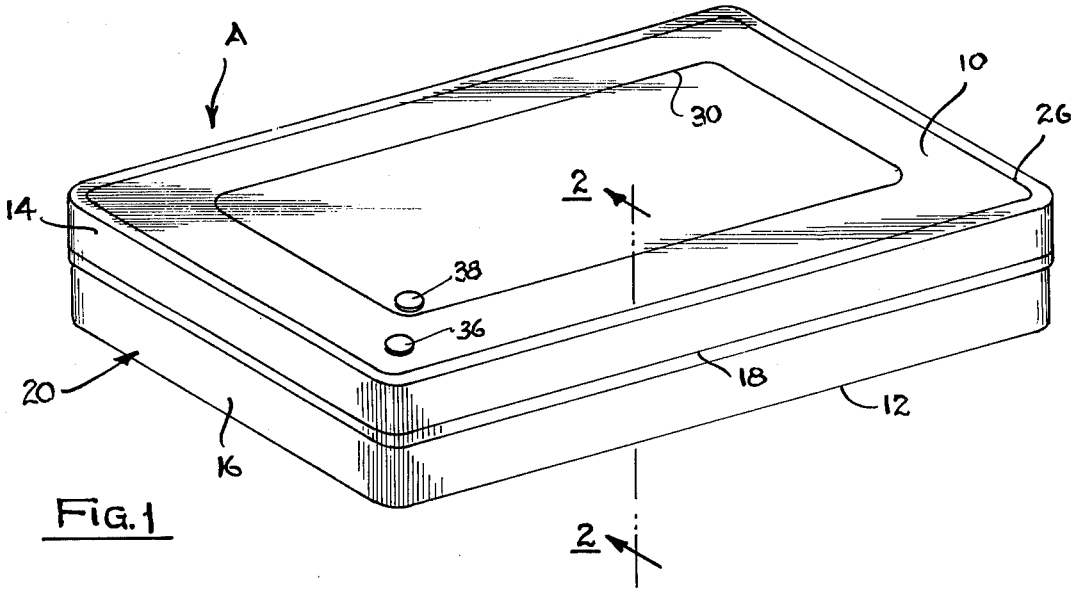
Figure 2:
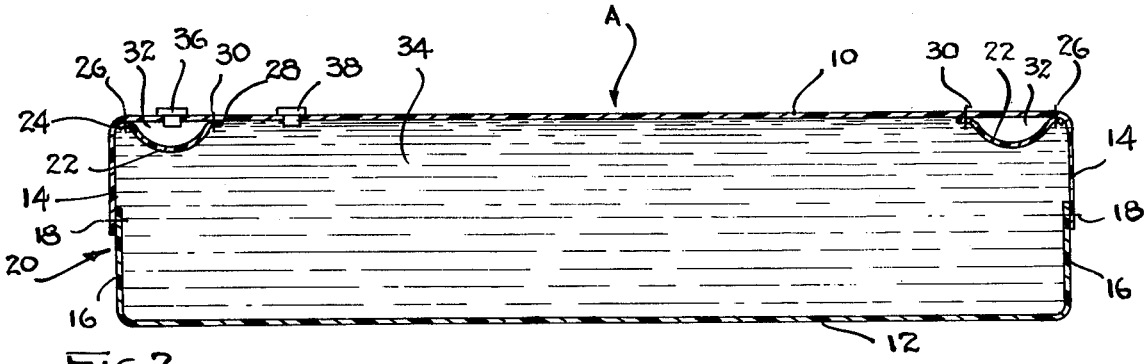
Figure 3:
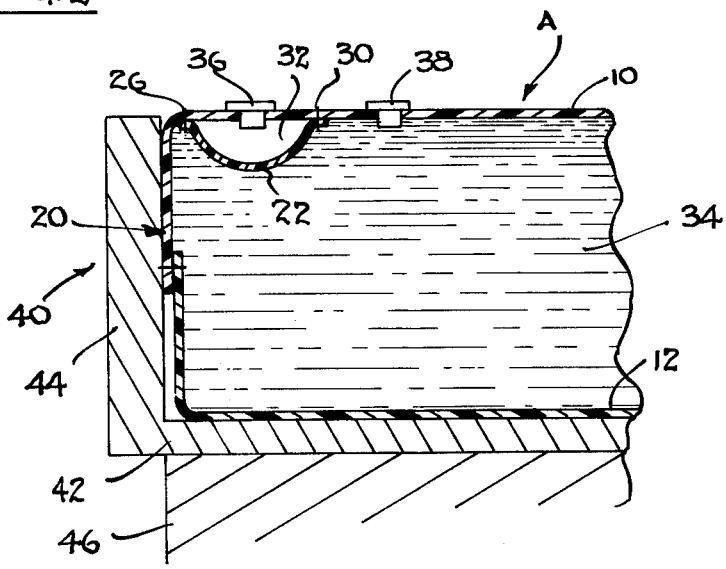
Figure 4:
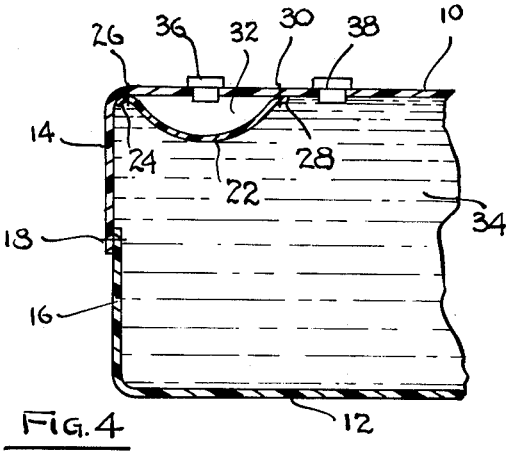
Figure 5:
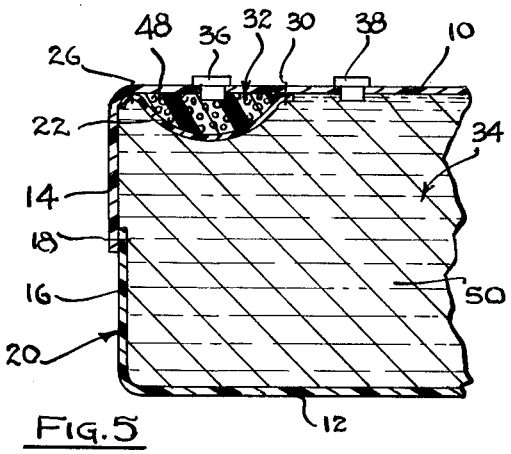
Figure 6:
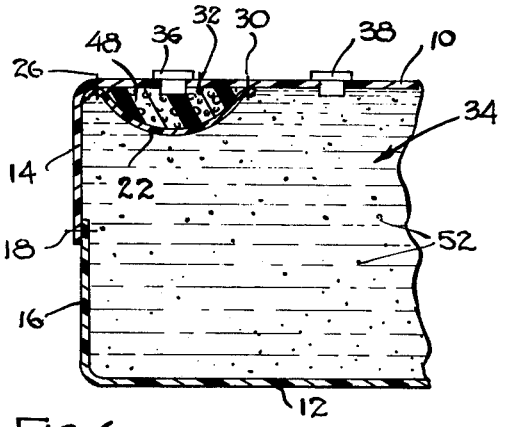
Figure 7:
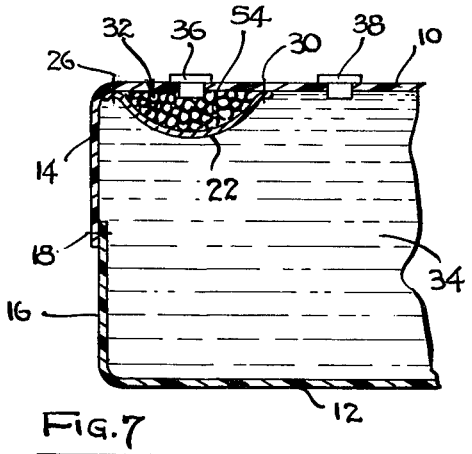
Figure 8:
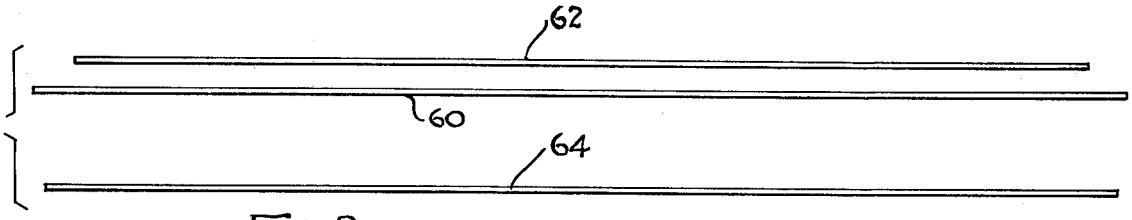
Figure 9:
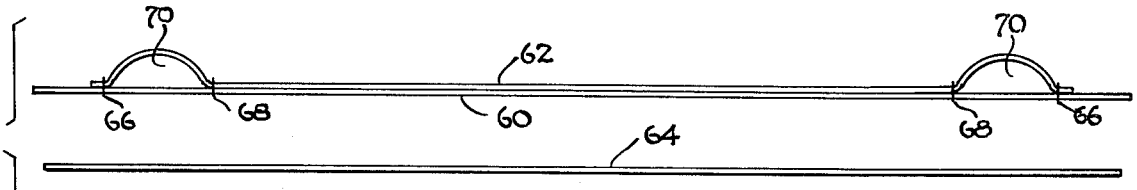
Figure 10:
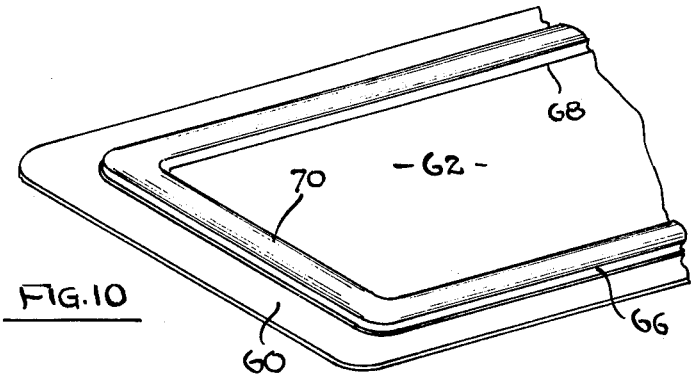
Figure 12:
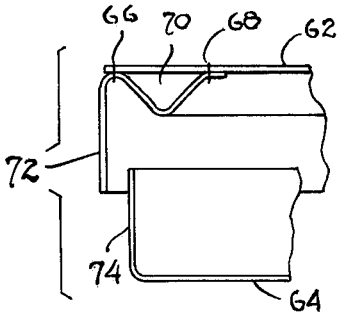
Figure 11:
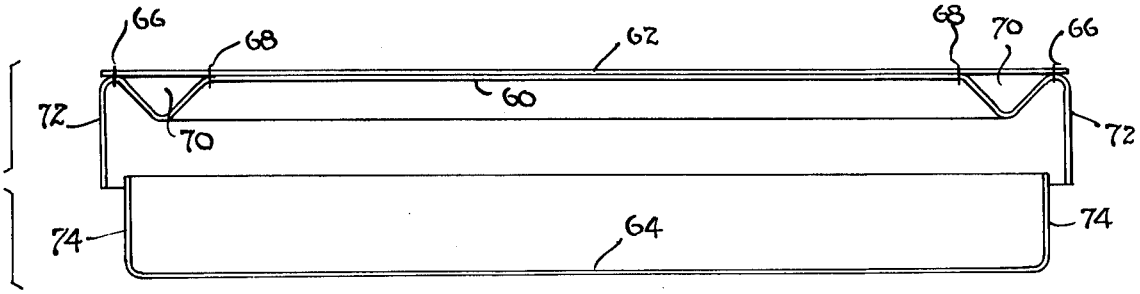
Figure 13:
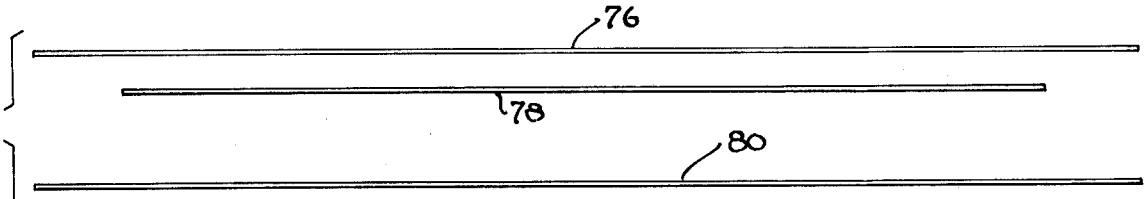
Figure 14:
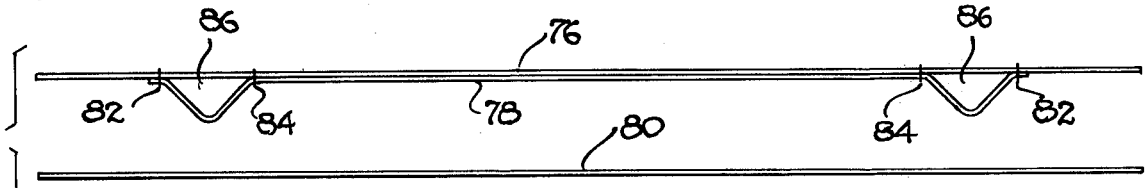
Figure 15:
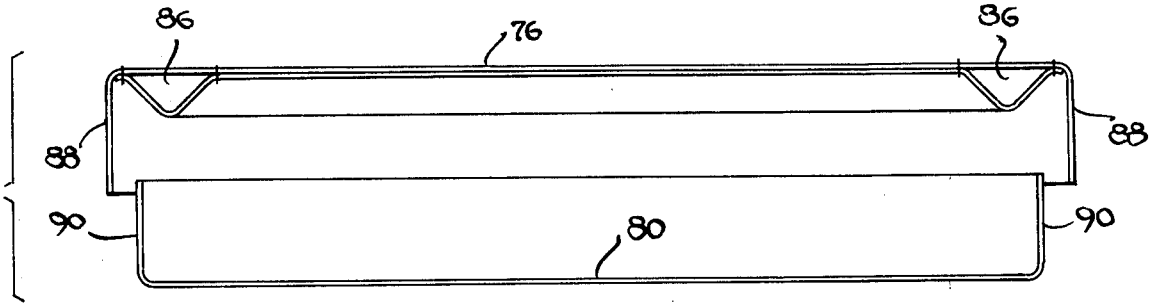

Having thus described the invention in general terms, reference will now be made to the accompanying drawings in which:

FIG. 1 is a perspective view of a water bed mattress constructed in accordance with and embodying the present invention;

FIG. 2 is a vertical sectional view taken along line 2—2 of FIG. 1;

FIG. 3 is a fragmentary vertical sectional view similar to FIG. 2 and showing the water bed mattress located in a frame;

FIG. 4 is an enlarged fragmentary vertical sectional view and showing a portion of the water bed mattress of FIGS. 1–3;

FIG. 5 is a fragmentary vertical sectional view, similar to FIG. 2, and showing still a further modified form of water bed mattress constructed in accordance with and embodying the present invention;

FIG. 6 is a fragmentary vertical sectional view, similar to FIG. 2, and showing a slightly different form of construction of the water bed mattress of FIG. 5;

FIG. 7 is a fragmentary vertical sectional view, similar to FIG. 5, and showing still another modified form of construction of the water bed mattress;

FIG. 8 is a schematic side elevational view showing a first step in the manufacture of a water bed mattress of the type illustrated in FIG. 1 of the drawings;

FIG. 9 is a schematic side elevational view showing a second step in the manufacture of the water bed mattress of FIG. 1 and specifically illustrating the attachment of an intermediate sheet to the upper sheet forming part of the water bed mattress;

FIG. 10 is a fragmentary perspective view showing the arrangement of the sheets illustrated in FIG. 9 of the drawings;

FIG. 11 is a schematic side elevational view, similar to FIG. 9, and showing a third step in the manufacture of the water bed mattress of FIG. 1;

FIG. 12 is a schematic side elevational view, similar to FIG. 11, and showing the removal of a portion of the intermediate sheet in the manufacture of the water bed mattress;

FIG. 13 is a schematic side elevational view, similar to FIG. 8, and showing a slightly modified method used in the manufacture of the water bed mattress;

FIG. 14 is a schematic side elevational view, similar to FIG. 13, and showing a second step in the modified method of making the water bed mattress; and FIG. 15 is a schematic side elevational view, similar to FIG. 14, and showing the further completion steps in order to produce the water bed mattress.

DETAILED DESCRIPTION

Referring now in more detail and by reference characters to the drawings which illustrate preferred embodiments of the present invention, A designates a water bed mattress comprising an upper flexible plastic sheet 10 and a lower flexible plastic sheet 12, and both of which are substantially rectangular in their construction, but with rounded corner margins.

The upper and lower sheets 10 and 12 are both substantially of the same overall size and are marginally registered with each other, and the upper sheets includes an integrally formed, downwardly struck peripherally extending end flap 14. In like manner, the lower wall 12 includes an integrally formed upwardly struck peripherally extending flap 16 which is lap-sealed to the end flap 14 at a seal 18, thereby forming a peripheral outer end wall 20. In this case, it can be observed that the flap 14 which is integral with the upper wall 10 is located exteriorly of the flap 16 in order to form the lap-seal 18. However, it should also be understood that the flap 16 could be located exteriorly of the flap 14 in order to form the lap-seal 18.

Extending across a peripheral portion of the top wall 10 is a continuous, peripherally extending panel 22, which is provided with a terminal flange 24 at its outermost end, and which is heat sealed to the top wall at its peripheral margin by means of a heat seal 26. In like manner, the inner edge of the continuously extending panel 22 is similarly provided with a terminal flange 28 which is similarly heat sealed to the underside of the top sheet 10 by means of a heat seal 30.

In accordance with the above-outlined construction, it can be observed that the panel 22, along with a portion of the upper sheet 10, form an interior air chamber 32. In like manner, a water chamber 34 is formed within the remaining portions of the water bed mattress and is bounded by the remaining portion of the top wall 10, the peripheral end wall 20, the panel 22, and the bottom wall 12. It can be observed that the air chamber 32 thereby constitutes an upper flotation pocket which extends peripherally around the peripheral end portion of the upper sheet 10.

In this respect, it can be observed that the flanges 24 and 28 on the panel 22 are heat sealed to the upper sheet 10 by means of lap seals, although any other form of seal may be employed. In the preferred aspect of the present invention, these laps seals are formed by means of radio frequency curing. In like manner, the heat seal 18 is also illustrated as being a lap seal, although a butt seal could be employed. Nevertheless, in accordance with the present invention, the lap seals are generally preferred in the construction of the water bed mattresses inasmuch as they provide a greater degree of safety with respect to the sealing of the various plastic components.

The water bed mattress A is provided with a first valve 36 which is essentially conventional in its construction and which communicates with the air chamber 32 for providing introduction and removal of air with respect to the chamber 32. In like manner, the top sheet 10 is similar provided with a second valve 38 which communicates with the water chamber 34 and also provides a means for introducing water into and removing water from the water chamber 34. These valves 36 and 38 may adopt the form of fittings which are integral with respective plastic sheets and provided with removable, but nevertheless fluid-tight, caps in order to provide entry and exit of either water or air from their respective chambers 32 and 34. In essence, these valves 36 and 38 may adopt several constructions and are essentially conventional in their nature.

In the preferred aspect of using the valves 36 and 38, these valves are generally closely spaced in relationship to the heat seal 30. In this way, it is possible to substantially increase the overall efficiency of including the valves within the upper sheet 10 in closely spaced proximity to this heat seal 30.

FIG. 3 illustrates an embodiment of the present invention in which the mattress A is located within a rigid support frame 40 comprised of a base frame plate 42 and an upstanding peripheral end wall 44. The frame 40 is generally formed of a wooden material or any other material which is used as a structural member in supporting and retaining the water bed mattress A. In this respect, the upstanding end wall 44 is generally rectangularly shaped and extends around the periphery of the side wall 20 so as to retain the entire water bed mattress A. Moreover, the frame 40 is supported on a base or pedestal 46 which is also generally of conventional construction. In this respect, it can be observed that the water bed mattress A of the present invention is not necessarily a self-supporting water bed mattress and is more effectively used with a rigid support frame.

In each of the aforesaid embodiments of the water bed mattress described herein, these embodiments have been described in connection with the utilization of a water bladder and an air bladder. Nevertheless, the water bladder, or water chamber, may be provided with any liquid medium which is capable of reducing the overall weight of the water bed mattress. One of the primary problems in the use of many water bed mattresses is that the supporting structure, such as the floor in the house or other enclosure, is not oftentimes capable of supporting the weight of several hundred gallons of water. Consequently, it is desirable to reduce this weight as much as possible, without otherwise compromising the effects of the air bladder which is designed to reduce sharp impingement of localized forces, wave motion and the like. Thus, the water chamber is oftentimes referred to hereinas a liquid or otherwise a fluid chamber and which may accommodate liquids other than water.

In many cases, the liquids could be provided with another substance in order to produce a specific weight thereof, but nevertheless provide the required support in the same manner as water provides such support. In addition, other materials may be incorporated in the air chamber so that air is not required to be introduced into this inner chamber. Moreover, by physically incorporating such solid or semi-solid materials in the chamber which normally incorporated the air chamber and which is hereinafter referred to as a "material chamber" or a "material-containing chamber" or "chamber containing a material therein" or the like, it is possible to eliminate the extra valve for introducing air into this chamber or bladder.

FIG. 5 illustrates another embodiment of a water bed mattress and which is similar to the water bed mattress illustrated in FIGS. 1-4 of the drawings. In this case, the water bed mattress comprises an upper wall 10, a lower wall 12, and a peripheral end wall 20. A continuous panel 22 divides the mattress into a liquid containing chamber 34 and a material-containing chamber 32. In this case, the liquid chamber 34 would normally contain a liquid, which could be water, or any other form of liquid. In many cases, the other liquid could actually be a mud solution. Nevertheless, the material-containing chamber 32 could be provided with a solid material which, in this case, could be a urethane foam, or other foamable or plastic material, designated as 48. It can be observed that in the manufacture of the mattress, in this case, the urethane material could be formed by actually including a precatalyzed polyol and polyisocyanate, such as a diisocyanate, and which materials are reactive to form the actual urethane in order to completely fill the chamber 32. In the same respect, a gelling agent is included in the liquid chamber so that the liquid may be somewhat of a gel 50, as illustrated in FIG. 5 of the drawings. In this case, while the liquid may be thickened, and actually be somewhat of a semi-solid or otherwise a semi-liquid, it is still referred to herein as a liquid. For example, such suitable gelling agents which may be used are carboxymethyl cellulose or the like.

FIG. 6 illustrates a further modified form of mattress of the present invention, and which similarly includes a liquid chamber 34 and a material-containing chamber 32. In this case, the material-containing chamber 32 may include any of those solid or semi-solid materials mentioned above. Moreover, the liquid chamber 34 may include water or any other form of liquid material. However, in this case, microballoons 52 are incorporated in the liquid. These microballoons are well-known in their construction, and therefore are neither illustrated nor described in any further detail herein. However, it is important to note that these microballoons do not hinder the support provided for an individual inclined on the upper surface of the mattress, but nevertheless substantially reduce the weight thereof.

FIG. 7 illustrates a form of mattress which is somewhat similar to the structure illustrated in FIG. 5 and which similarly includes a liquid chamber 34 and a material-containing chamber 32. In this case, the material-containing chamber 32 may include a pelletized form of material 54 and the liquid chamber 34 may include water or any other form of liquid material, as shown. The material-containing chamber 32 may actually contain any of those materials which may be incorporated in the material-containing chambers as previously described. In like manner, the liquid-containing chamber 34 may contain any of those materials which were contained in the liquid chambers, as also previously described. In this connection, it can be observed that any of the mattress constructions, as heretofore described, could be used with any of the liquids other than water and any solid or semi-solid material in place of air.

In each of the previously described embodiments of the water bed mattress of the present invention, any of a number of plastic materials may be used, and include for example, various forms of vinyl sheets, polyethylene, polystyrene, and polybutadiene copolymers and the like. While the materials mentioned above are thermoplastics in nature, it should be understood that many thermo-setting resins could also be used. In addition, various flexible non-plastic materials could also be employed, as for example, various textile materials which are water impervious and which may be plastic impregnated, such as those cloth materials which are impregnated with a vinyl plastic material to render the same water impervious. The upper and lower sheets, as well as the outer peripheral side wall and the panel 22, should preferably have a thickness of no less than 20 mils. However, the desired thickness may be predicated upon the overall size of the mattress itself.

Several unique features are inherently created in the water bed mattresses of the present invention which include the advantage that they are relatively light in weight, compared to other conventional prior art water bed mattresses, due to the large air chamber which surrounds the upper portion of the water chamber. In addition, the water bed mattresses of the present invention provide a more substantially constant support due to the fact that the air bladder is effectively located at the upper portion of the water bladder and which thereby produces a constant flotation on the remaining portions of the top of the water bed mattress. In addition, the air chamber serves to effect as a baffle which thereby inhibits water motion and, hence, the wave action which would otherwise be created by a sudden impact or otherwise a localized force impingement on the surface of the water bed mattress. In this way, it can be observed that there is an increased ease of exit and entry with respect to the water bed mattress.

In the conventional complete water bladder mattress, it was virtually impossible to sit on the edge of the water bed inasmuch as the water would displace and the sheet portion in the area of displacement would collapse. In the conventional air frame surrounded water bed mattress, the air frame was too rigid and thereby prevented an effective resting while sitting position.

In addition to the above, the water bed mattresses of the present invention provide a substantially increased fit with respect to a surrounding support frame. Moreover, the water bed mattresses of the present invention provide a substantially increased safety factor when compared to any other conventional form of water bed mattress. In this case, it can be observed that the air chamber 32 substantially completely surrounds a portion of the upper sheet of the water chamber 34, such that if any portion of the sheet material forming the water chamber adjacent to the air chamber were perforated or otherwise punctured, the air chamber 32 surrounding this water chamber 34 would prevent discharge of any of the water which might otherwise be expelled from the water chamber.

In addition to the foregoing advantages of the water bed mattresses of the present invention, these mattresses are highly unique in that they enable the user thereof to regulate the air pressure in the air bladder relative to the amount of water in the air bladder, and thereby provide adjustable support. In this way, an individual may rest or sleep across the entire top surface of the mattresses which are supported on their periphery by an air bladder. In addition to the adjustable firmness, no bottoming-out can occur. Moreover, since the water bladder is smaller than water chambers in conventional water bed mattresses, the mattresses of the present invention can be filled quicker and drained quicker. Furthermore, due to less water content, less energy is required to heat the water to a desired water bed temperature. Thus, longer life is afforded to the water bed mattresses of the present invention since lesser pressure is exerted upon the various seams in the mattresses.

Moreover, and in the same connection, an individual may rest or sleep across the entire top surface of the mattresses which are supported on their periphery by the material-containing bladder or chamber. Consequently, even though air is not necessarily used in the material-containing chamber, no bottoming-out can occur. Nevertheless, the liquid in the liquid-containing chamber provides the necessary support.

The present invention also provides several unique advantages which are not available by many of the prior art water bed mattress constructions and which include the advantage of equalizing for the differential in body mass lying on the water bed mattress. In many cases, if more than one individual was residing on the mattress, the weight of one individual, as compared to the other, would tend to displace the water and thereby create a pocket in the center of the mattress which would cause the other of the individuals to move toward the center of the mattress. In addition, the upper air chamber creates an air buoyancy support for firmness in the mattress, such that an individual lying on the mattress cannot sink below or rise above the mattress surface.

Moreover, it can be observed that the air chamber cannot rise above the actual upper surface of the water bed mattress. Inasmuch as the air chamber is not free-floating, one portion thereof cannot be displaced relative to another portion. In this way, if an individual sits on one edge of the water bed mattress, the air chamber on the opposite side of the mattress cannot be displaced. Moreover, and in this same respect, the air chamber does not have to be filled with a substantial pressure in order to make the same firm. Inasmuch as the water in the water chamber holds the air bladder in an upward position, the air pressure within this air chamber can be sufficiently soft so as to enable an individual to sleep on this portion of the mattress. In addition, the air chamber provides excellent corner support which is not available in any other form of water bed mattress.

The method of making the water bed mattress has actually been set forth in some detail in connection with the actual descriptions of the water bed mattresses illustrated in FIGS. 1–7 of the drawings. FIGS. 8–12 of the drawings more fully illustrate the method steps which are utilized in constructing the water bed mattress of the present invention. In accordance with the producing of the water bed mattress A of the present invention, a sheet 60 is provided and which has a size and shape at least approximately equal to the upper sheet 10 of the water bed mattress A. In this embodiment of the method of making the mattress, the sheet 60 is referred to as an intermediate sheet. Disposed above the intermediate sheet 60 is a top sheet 62, and, finally, disposed beneath the intermediate sheet 60 is a bottom sheet 64.

The upper sheet 62 in this case has a slightly shorter peripheral dimension than the intermediate sheet 60. Moreover, the top sheet 62 is heat sealed to the intermediate sheet 60 with a first peripheral continuously extending heat seal 66, somewhat in close proximity to the peripheral margin of the intermediate sheet 60. In addition, the top sheet 62 is also sealed to the intermediate sheet 60 at a second continuously extending heat seal 68 located inwardly of the continuous heat seal 66, to thereby provide a material-containing chamber 70 between the pair of continuously extending, spaced apart heat seals 66 and 68, in the manner as illustrated in FIGS. 9 and 10 of the drawings.

The peripheral portion of the intermediate sheet 60 is thereupon struck downwardly to provide a peripherally extending flap 72. In like manner, the lower sheet is provided with an upwardly struck peripherally extending flap 74, in the manner as illustrated in FIG. 11 of the drawings. In this case, it can be observed that the top sheet 62 essentially corresponds to the intermediate sheet 60 and the panel 22 in the mattress of FIG. 1 actually corresponds to portions of the top sheet 62. Moreover, the lower sheet 64 corresponds to the lower sheet 12. In addition, the downwardly struck flap 72 on the intermediate sheet 60 actually corresponds to the downwardly struck flap 14, and the upwardly struck flap 74 on the lower sheet 64 corresponds to the upwardly struck flap 16. It can be observed that when these two flaps 72 and 74 are sealed together, they will form the peripheral side wall 20. Moreover, it can also be observed that when these flaps are sealed together, the material chamber 70 essentially constitutes the material-containing chamber 32 as illustrated in FIGS. 1 and 2 of the drawings. Moreover, the liquid chamber 34 corresponds to the liquid chamber illustrated in FIG. 11 of the drawings.

In this case, it can be observed that the major portion of the sealed upper sheet 62 and intermediate sheet 60 is comprised of two plys of the plastic material. However, in order to more fully provide a water bed mattress with a consistent thickness throughout, the portion of the intermediate sheet 60 between the continuously extending heat seal 68 is removed, in the manner as illustrated in FIG. 12. Thereafter, the upwardly struck flap 74 and the downwardly struck flap 72 are heat sealed together in the same manner as illustrated in FIG. 2 of the drawings.

In this way, it is possible to provide a water bed mattress with an upper flotation pocket which can be made with a minimum number of manual operations and which thereby minimizes the necessity of direct labor costs. Moreover, the required heat sealing steps are also reduced and which thereby lends to an improved efficiency in the water bed mattress.

It can be observed in accordance with the present invention that when the flap 72 is struck downwardly, the flap 72 does not include a portion of the material-containing chamber 70 such that the material-containing chamber 70 is located adjacent to only a portion of the top wall or sheet 10. In this way, only the intermediate sheet 60, along with the top sheet 62, actually cooperates to form the material-containing chamber.

In this same respect, it should also be observed that either the intermediate sheet 60 or the top sheet 62 could actually be integral with the lower sheet 64 and unrolled from a continuous roll of the plastic material. In this way, the intermediate sheet 60 or the top sheet 62 would actually be continuous with and integral with the lower sheet 64 at one end, with the upper sheet 62 or the intermediate sheet 60 folded over the lower sheet 64.

FIGS. 13–15 illustrate a slightly modified form of making the water bed mattress in accordance with the present invention. When considering the method illustrated in FIGS. 8–12, it can be observed that the heat seals, such as the heat seals 66 and 68, were located on the exterior surface of the mattress. In accordance with the method illustrated in FIGS. 13–15, the heat seals would be located on the interior surface of the mattress so that they are not necessarily apparent to visual observation.

In accordance with the method of FIGS. 13–15, a top sheet 76 is provided and which is substantially equivalent to the top sheet 62. In like manner, an intermediate sheet 78 is also provided and which is substantially similar to the intermediate sheet 60. Finally, a lower sheet 80, corresponding to the lower sheet 64, is also provided.

The intermediate sheet 78 is heat sealed to the top sheet 76 at a first continuous peripherally extending heat seal area 82. Thereafter, the intermediate sheet 78 is similarly heat sealed to the top sheet 76 at a second heat seal 84 which is located inwardly of the heat seal 82 in a generally rectangular pattern. Moreover, the continuous heat seals 82 and 84 form a material-containing chamber 86 which is essentially equivalent to the material-containing chamber 32.

Thereafter, the top sheet 76 is provided with terminal flange portions 88 which are folded downwardly in the manner, the lower sheet 80 is provided with upwardly extending flanges 90 also in the manner as illustrated in FIG. 15 of the drawings. The downwardly struck flanges 88 correpond essentially to the flanges 14, as illustrated in FIGS. 1 and 2, and the upwardly struck flanges 90 essentially correspond to the upwardly struck flanges 16, as illustrated in FIG. 2. When these two flanges 88 and 90 are secured together, they will thereby provide the liquid chamber 34, as illustrated in FIG. 2. In this way, it can be observed that the heat seals are located on the interior portion of the mattress which thereby enables the formation of the material-containing chamber 86, which again corresponds to the material-containing chamber 32.

As illustrated in FIGS. 12 and 15 of the drawings, the angularly struck flaps 72 and 74, as well as the angularly struck flaps 88 and 90, are not sealed together. However, in order to complete the formation of the water bed mattress, these flaps would be heat sealed together at an annular heat seal, such as the heat seal 26, in order to form the complete water bed mattress illustrated in FIGS. 1 and 2 of the drawings.

Thus, there has been illustrated and described various forms of novel mattress constructions, as well as methods for making the same, and which mattresses can be made at a relatively low cost and used in a wide variety of applications. Consequently, the mattresses described herein and the methods of making the same fulfill all the objects and advantages sought therefor. Many changes, modifications, variations and other uses and applications of water bed mattresses and the method of making the same will become apparent to those skilled in the art after considering this specification and the accompanying drawings. Therefore, any and all such changes, modifications, variations and other uses and applications which do not depart from the spirit and scope of the invention are deemed to be covered by the invention which is limited only by the following claims.

Having thus described my invention, what I desire to claim and secure by letters patent is:

1. A mattress for use in a rigid containing frame for supporting an individual in an inclined position and which mattress generally assumes its peripheral shape from said frame, said mattress comprising:

a. an upper sheet, b. a lower sheet in spaced apart relationship to said upper sheet, c. a continuous outer side wall extending between and secured in operative relationship to said upper and lower sheets, d. a continuous panel operatively secured to said upper sheet inwardly of a peripheral end margin of said upper sheet by a first continuous seal, said panel also being secured to said upper sheet at a point in close proximity to the peripheral margin thereof by a second continuous seal to form a material-containing chamber bounded by at least a portion of said upper sheet and said panel between said first and second seals, with a liquid chamber bounded at least by said lower sheet, said side wall, and a portion of said upper sheet, and e. said material-containing chamber extending continuously around the periphery of the upper sheet and being located above the liquid chamber at least in the region between said first and second seals and effectively being on top of said liquid chamber so that it is free of certain hydrostatic pressures which would otherwise be exerted on the material-containing chamber and so that an individual reclining on said upper sheet may be peripherally supported by the material in said material-containing chamber.

2. The mattress of claim 1 further characterized in that said upper and lower sheets have angularly struck flaps which are respectively integral with said upper and lower sheets and which flaps are sealed to each other to form said outer side wall, and said panel having terminal extending flanges which are sealed to said upper sheet.

3. The mattress of claim 2 further characterized in that said flanges are lap sealed to the upper sheet.

4. The mattress of claim 1 further characterized in that said upper and lower sheets have respective downwardly and upwardly struck flaps which are integral with said respective upper and lower sheets, said panel having a terminal flange extending peripherally therearound which is heat sealed to said upper sheet in close proximity to its peripheral margin and said panel having another flange extending peripherally therearound on its opposite side and being heat sealed to said upper sheet inwardly of its peripheral end margin.

5. The mattress of claim 1 further characterized in that said upper and lower sheets and said panel and outer side wall are formed of a flexible, foldable plastic material.

6. The mattress of claim 1 further characterized in that said material-containing chamber is filled with a material having a specific weight which is substantially less than the specific weight of the liquid introduceable in said liquid chamber.

7. The mattress of claim 6 further characterized in that said mattress is filled with water in said liquid chamber.

8. The mattress of claim 6 further characterized in that the material chamber is filled with a relatively solid material.

9. The mattress of claim 6 further characterized in that weight reducing matter is included in the liquid in said liquid chamber.

10. The mattress of claim 6 further characterized in that said material-containing chamber is filled with a light-weight celled type material.

11. A water bed mattress for use in a rigid containing frame for supporting an individual in an inclined position and which mattress generally assumes its peripheral shape from said frame, said mattress comprising:

a. an upper sheet, b. a lower sheet in spaced apart relationship to said upper sheet, c. a continuous outer side wall extending between and secured in operative relationship to said upper and lower sheets, d. a continuous panel being operatively secured to said upper sheet inwardly of a peripheral end margin of said upper sheet by a first continuous seal, said panel also being secured to said upper sheet at a point in close proximity to the peripheral margin thereof by a second continuous seal to form an air chamber bounded at least by a portion of said upper sheet between said first and second seals and said panel, with a water chamber bounded by at least said lower sheet, said side wall and a portion of said upper sheet, and e. said air-containing chamber extending continuously around the periphery of the upper sheet and being located above the water chamber at least in the region between said first and second seals and effectively being on top of said water chamber so that it is free of certain hydrostatic pressures which would otherwise be exerted on the air-containing chamber and so that an individual reclining on said upper sheet may be peripherally supported by the air in said air chamber.

12. The mattress of claim 11 further characterized in that said upper and lower sheets have angularly struck flaps which are respectively integral with said upper and lower sheets and which flaps are sealed to each other to form said outer side wall, and said panel having terminal peripherally extending flanges which are sealed to said upper sheet.

13. The mattress of claim 12 further characterized in that said flanges are lap sealed to the upper sheet.

14. The mattress of claim 11 further characterized in that said upper and lower sheets and said panel and outer side wall are formed of a flexible, foldable plastic material.

15. The mattress of claim 11 further characterized in that a first valve is located in one of the upper sheet or the panel and communicating with said air chamber, and a second valve is located in the upper sheet and communicating with said water chamber, said valves both being located in close proximity to said first continuous seal.

16. In a water bed mattress comprised of an upper sheet and a lower sheet and a peripherally extending side wall secured to said upper and lower sheets to form a water chamber therebetween, an improvement comprising a continuous panel operatively secured to said upper sheet inwardly of the peripheral end margin of said upper sheet by a first continuous seal, said panel also being secured to said upper sheet at a point in close proximity to the peripheral margin thereof by a second continuous seal to form an air chamber bounded by at least a portion of said upper sheet and said panel, with a water chamber bounded by at least said lower sheet, said side walls, and a portion of said upper sheet, and said air chamber extending continuously around the periphery of the upper sheet and being located above the water chamber at least in the region between said first and second seals so that an individual reclining on said upper sheet may be peripherally supported by the air in said air chamber.

17. The mattress of claim 16 further characterized in that said upper and lower sheets have angularly struck flaps which are respectively integral with said upper and lower sheets and which flaps are sealed to each other to form said outer side wall, and said panel having terminal peripherally extending flanges which are sealed to said upper sheet.

18. The mattress of claim 17 further characterized in that said flanges are lap sealed to the upper sheet.

19. The mattress of claim 16 further characterized in that said upper and lower sheets have respective downwardly and upwardly struck flaps which are integral with said respective upper and lower sheets, said panel having a terminal flange extending peripherally therearound which is heat sealed to said upper sheet and said panal having a flange extending peripherally therearound on its opposite side and being heat sealed to said upper sheet inwardly of its peripheral end margin.

20. The mattress of claim 1 further characterized in that said panel is secured to the outermost surface of said upper sheet so that said material-containing chamber is bounded by a portion of said upper sheet and said panel, and said water chamber is bounded by said lower sheet, said side wall and said upper sheet.

21. The mattress of claim 1 further characterized in that said panel is secured to the interior surface of said upper sheet so that said material containing chamber is bounded by a portion of said upper sheet and said panel, and said liquid chamber is bounded by a portion of said upper sheet, said side wall, said lower sheet and said panel.

22. The mattress of claim 11 further characterized in that said panel is secured to the outermost surface of said upper sheet so that said air chamber is bounded by said upper sheet and said panel, and said water chamber is bounded by said lower sheet, said side wall and said upper sheet.

23. The mattress of claim 11 further characterized in that said panel is secured to the interior surface of said upper sheet so that said air chamber is bounded by a portion of said upper sheet and said panel, and said water chamber is bounded by a portion of said upper sheet, said side wall, said lower sheet and said panel.

24. The improvement in the mattress of claim 16 further characterized in that said panel is secured to the outermost surface of said upper sheet so that said air chamber is bounded by said upper sheet and said panel, and said water chamber is bounded by said lower sheet, said side wall and said upper sheet.

25. The improvement in the mattress of claim 16 further characterized in that said panel is secured to the interior surface of said upper sheet so that said air chamber is bounded by a portion of said upper sheet and said panel, and said water chamber is bounded by a portion of said upper sheet, said side wall, said lower sheet and said panel.

26. A mattress for use in a rigid containing frame for supporting an individual in an inclined position and which mattress generally assumes its peripheral shape from said frame, said mattress comprising:

a. an upper sheet, b. a lower sheet in spaced apart relationship to said upper sheet, c. a downwardly struck flap integral with said upper sheet and an upwardly struck flap integral with said lower sheet, said flaps being sealed to each other to form a continuous outer side wall extending between said upper and lower sheets, d. a continuous panel operatively extending across said upper sheet from an area inwardly of the peripheral end margin of said upper sheet to an area in close proximity to the peripheral margin thereof, said panel having a terminal flange extending peripherally therearound which is heat sealed by a continuous seal to said upper sheet in close proximity to its peripheral margin and said panel having another flange extending peripherally therearound on its opposite side and being heat sealed by a second continuous seal to said upper sheet inwardly of its peripheral end margin to form a material-containing chamber bounded by at least a portion of said upper sheet and said panel between said first and second seals, with a liquid chamber bounded at least by said lower sheet, said side wall, and a portion of said upper sheet, said upper and lower sheets and said panel and outer side wall are formed of a flexible, foldable plastic material, e. a first valve located in one of the upper sheet or panel and communicating with the material containing chamber, and a second valve located in said upper sheet and communicating with said liquid chamber, said valves both being located in close proximity to the heat seal where the panel is secured to said upper sheet by the second continuous seal, f. said material-containing chamber extending continuously around the periphery of the upper sheet and being located above the liquid chamber at least in the region between said first and second seals and effectively being on top of said liquid chamber so that it is free of certain hydrostatic pressures which would otherwise be exerted on the material-containing chamber and so that an individual reclining on said upper sheet may be peripherally supported by the material in said material-containing chamber.

* * * * *